US008820392B2

(12) United States Patent
Weyer et al.

(10) Patent No.: US 8,820,392 B2
(45) Date of Patent: Sep. 2, 2014

(54) METHOD AND DEVICE FOR POSITIONING AT LEAST ONE ROLL SEGMENT OF A STRAND GUIDING UNIT AGAINST A STRAND

(75) Inventors: Axel Weyer, Wuppertal (DE); Christian Stolp, Düsseldorf (DE); Hans Esau Klassen, Willich (DE)

(73) Assignee: SMS Siemag Aktiengsellschaft, Dusseldorf (DE)

( * ) Notice: Subject to any disclaimer, the term of this patent is extended or adjusted under 35 U.S.C. 154(b) by 0 days.

(21) Appl. No.: 13/107,776

(22) Filed: May 13, 2011

(65) Prior Publication Data

US 2011/0220315 A1 Sep. 15, 2011

Related U.S. Application Data

(62) Division of application No. 12/085,416, filed as application No. PCT/EP2006/010063 on Oct. 19, 2006, now Pat. No. 8,205,661.

(30) Foreign Application Priority Data

Nov. 22, 2005 (DE) ..... 10 2005 055 530

(51) Int. Cl.

| | |
|---|---|
| ***B22D 11/128*** | (2006.01) |
| ***B22D 11/16*** | (2006.01) |
| ***B22D 11/20*** | (2006.01) |
| ***B22D 11/12*** | (2006.01) |

(52) U.S. Cl.

CPC ..... *B22D 11/1206* (2013.01); *B22D 11/208* (2013.01); *B22D 11/16* (2013.01)

USPC ..... 164/413; 164/442; 164/454; 164/484

(58) Field of Classification Search

CPC .. B22D 11/1206; B22D 11/128; B22D 11/16; B22D 11/208

USPC ..... 164/454, 484, 413, 441, 442

See application file for complete search history.

(56) References Cited

U.S. PATENT DOCUMENTS

| | | | | |
|---|---|---|---|---|
| 5,709,261 | A | 1/1998 | Streubel | |
| 6,102,101 | A | 8/2000 | Hanazaki et al. | |
| 6,386,268 | B1 | 5/2002 | Weyer et al. | |
| 6,536,506 | B2 * | 3/2003 | Nikolovski | 164/480 |
| 6,540,010 | B1 | 4/2003 | Geerkens et al. | |
| 6,837,301 | B2 * | 1/2005 | Nikolovski et al. | 164/480 |
| 6,871,693 | B2 | 3/2005 | Rahmfeld et al. | |
| 8,205,661 | B2 * | 6/2012 | Weyer et al. | 164/454 |

FOREIGN PATENT DOCUMENTS

| | | |
|---|---|---|
| EP | 1475169 | 11/2004 |
| JP | 8001221 | 1/1996 |
| JP | 8267206 | 10/1996 |
| JP | 11129003 | 5/1999 |
| JP | 2002522231 | 7/2002 |
| WO | 9946071 | 9/1999 |

* cited by examiner

*Primary Examiner* — Kevin P Kerns

(74) *Attorney, Agent, or Firm* — Lucas & Mercanti, LLP; Klaus P. Stoffel

(57) ABSTRACT

A method for adjusting a roll segment of a strand guide of a slab-casting installation against a strand, wherein the roll segment has an upper and a lower roll support that each have an adjusting element for adjusting the two roll supports relative to each other. The method includes individual control of the individual adjusting elements, wherein the actual profile of the strand, including the heights of the right and left lateral edges of the strand, is detected and compared with a set profile that includes a predetermined set height, which is the same for the right and left lateral edges, and the individual adjusting elements of the roll segment are individually controlled based on the control deviation that results from the comparison so that the actual profile is adapted to the set profile, including equalization of the heights of the right and left lateral edges of the strand.

7 Claims, 3 Drawing Sheets

METHOD AND DEVICE FOR POSITIONING AT LEAST ONE ROLL SEGMENT OF A STRAND GUIDING UNIT AGAINST A STRAND

CROSS-REFERENCE TO RELATED APPLICATIONS

The present application is a Divisional Application of U.S. patent application Ser. No. 12/085,416, filed Sep. 15, 2008, now U.S. Pat. No. 8,205,661, which is a 371 of International application PCT/EP2006/010063, filed Oct. 19, 2006, which claims priority of DE 10 2005 055 530.6, filed Nov. 22, 2005, the priority of these applications is hereby claimed and these applications are incorporated herein by reference.

BACKGROUND OF THE INVENTION

The invention concerns a method for adjusting at least one roll segment of a strand guide of a slab-casting installation against a strand and a computer program and a strand guide for carrying out this method.

These kinds of methods and devices are basically already well known from the prior art.

European Patent Application EP 1 475 169 A1 discloses a support roll stand for continuous casting machines with roll segments. Each roll segment consists of a lower frame and an upper frame, which can be individually adjusted relative to each other by pairs of piston-cylinder units. Sensors, position sensors, pressure transducers, control valve blocks, and the like, which are assigned to the piston-cylinder units, are connected with a remotely disposed control system of the continuous casting installation. To reduce the cabling of the sensors, it is proposed that either a field bus system or a transmit/receive module for bidirectional transfer of data between the sensors and the control system of the continuous casting installation is provided on each upper frame. The Japanese document JP 11-129003 discloses a method and a corresponding device for the simple rolling of steel bar material with a wedge-shaped cross section.

International Patent Application WO 99/46071 discloses a method and a device for adjusting at least one roll segment of a strand guide against a strand. The roll segment has an upper and a lower roll support, each of which supports at least one roll for guiding the strand between the rolls. Each of the four corner regions of the roll segment has an adjusting element for adjusting the upper and lower roll supports relative to each other. To prevent damage to the roll segment due to the application of excessive force by the adjusting elements on the roll supports or on the rolls supported by the roll supports, the cited patent application proposes that the adjusting elements, which are realized as hydraulic cylinder units, can be adjusted both by automatic position control and automatic pressure control. All four of the adjusting elements of the roll segment are controlled synchronously, i.e., isochronously, and the values for the positions to which hydraulic cylinder units are adjusted are determined independently of one another by an automatic control unit. In this way, it is possible for each hydraulic cylinder to be automatically controlled essentially independently of the others. Positions are first preset for the hydraulic cylinders, i.e., they are basically position-controlled, and only after the pressure in the respective hydraulic cylinders has reached or exceeded a predetermined pressure threshold value is a shift made to pressure-controlled mode for controlling the hydraulic cylinders.

SUMMARY OF THE INVENTION

Proceeding from this prior art, the objective of the invention is to refine a previously known method for positioning a roll segment of a strand guide against a strand in such a way that the rolling stands located downstream of the strand guide can be relieved with respect to the tasks they must perform and with respect to their mechanical loading during their operation and in such a way that the quality of the strand is improved.

This method is characterized by the fact that the actual profile of the strand, including the heights of the right and left lateral edges of the strand, is detected and compared with a set profile that includes a predetermined set height, which is the same for the right and left lateral edges, and that the individual adjusting elements of the roll segment are individually controlled on the basis of the control deviation that results from the comparison in such a way that the actual profile is adapted to the set profile, including equalization of the heights of the right and left lateral edges of the strand.

Traditionally, it was the task of the rolling stands located downstream of the strand guide to even out any wedging in the strand profile, i.e., unequally high lateral edges of the strand, that might be present in a strand fed into the rolling stands. However, this led to undesirable uneven mechanical loading of the rolls in the rolling stand over the width of each roll and thus to undesirable uneven wear of the rolls. The invention effectively ensures that any wedging of the profile that might be present in the cast strand is evened out while it is still in the strand guide, i.e., before it enters the downstream rolling stands. Ideally, the present invention thus ensures that only a strand with no wedging is ever fed to the rolling stands. In this way, the rolling stands are relieved both mechanically and with respect to the task they formerly had of eliminating any possible wedging of the strand; ultimately, the quality of the strand is also improved.

In accordance with a first embodiment of the invention, the possible wedging is eliminated in the strand guide at a position or at roll segments at which the strand has not yet completely solidified. This has the advantage that the elimination of the wedging requires the application of much smaller forces on the strand by the rolls of the roll segment than if the strand were already completely solidified, as is generally the case upon entrance into the downstream rolling stands.

Advantageously, to eliminate the wedging, the adjusting elements can be individually adjusted only in individual roll segments, in several roll segments, or in all roll segments of the strand guide. Although an adjustment of the adjusting elements in several roll segments requires technically greater complexity, it has the advantage that smaller forces can then be applied with the individual adjusting elements; this is due especially to the fact that then a large number of adjusting elements in several roll segments are available for overall evening out of the wedging.

The adjustment of the adjusting elements for evening out the wedging can be accomplished either with open-loop or closed-loop control. In the case of open-loop control, only an equal set height for the right and left lateral limit of the strand is preset, and the adjusting elements on the right and left side of the roll segment (as viewed in the direction of material flow) are controlled accordingly. In the case of closed-loop control, the heights of the right and left lateral edge of she strand are detected and compared for the purpose of determining a corresponding control deviation with a predetermined equal set height in each case for the right and left lateral edge. The individual adjusting elements of the roll segment are then individually controlled according to the control deviation in such a way that the heights of the right and left lateral edge of the strand are each rolled to the predetermined equal set height.

Alternatively to the pure closed-loop control of the heights on the right and left lateral edges of the strand, it is also possible to provide automatic profile control for the profile, i.e., the cross section of the strand. For this purpose, first the actual profile of the strand is determined and then compared with a predetermined set profile for the purpose of determining a profile control deviation. In this case as well, the individual adjusting elements of the roll segment are adjusted according to the previously determined profile control deviation for the purpose of adjusting the actual profile to the predetermined set profile. Of course, this profile adjustment includes equalization of the heights of the right and left lateral edge of the strand, which is absolutely necessary in accordance with the present invention.

It is advantageous for the heights of the lateral edges of the strand or the actual profile of the strand to be detected in different locations within the strand guide. The detection is preferably carried out at the exit of a roll segment of this type which has automatically controlled adjusting elements. The measured values are preferably determined at the exit of the last roll segment of the strand guide, i.e., shortly before the entrance to the rolling stand. Since each automatic control in accordance with the invention strives to reduce the aforementioned control deviations to zero, in this way it is ensured that in fact only a strand with lateral edges of the same height is supplied to the downstream rolling stand.

It is advantageous for any possible differences in the heights of the lateral edges of the cast strand to be calculated on the basis of measured force and/or pressure conditions, preferably in the area of contact of the adjusting elements. On the other hand, the actual profile of the strand can be detected, e.g., optically, with the use, e.g., of suitable profile detection systems.

The above-stated objective is also achieved by a computer program and a strand guide for carrying out the method described above. The advantages of the computer program and of the strand guide are essentially the same as the advantages that are associated with the claimed method.

The various features of novelty which characterize the invention are pointed out with particularity in the claims annexed to and forming a part of the disclosure. For a better understanding of the invention, its operating advantages, specific objects attained by its use, reference should be had to descriptive matter in which there are described preferred embodiments of the invention.

DETAILED DESCRIPTION OF THE INVENTION

Figure 1:
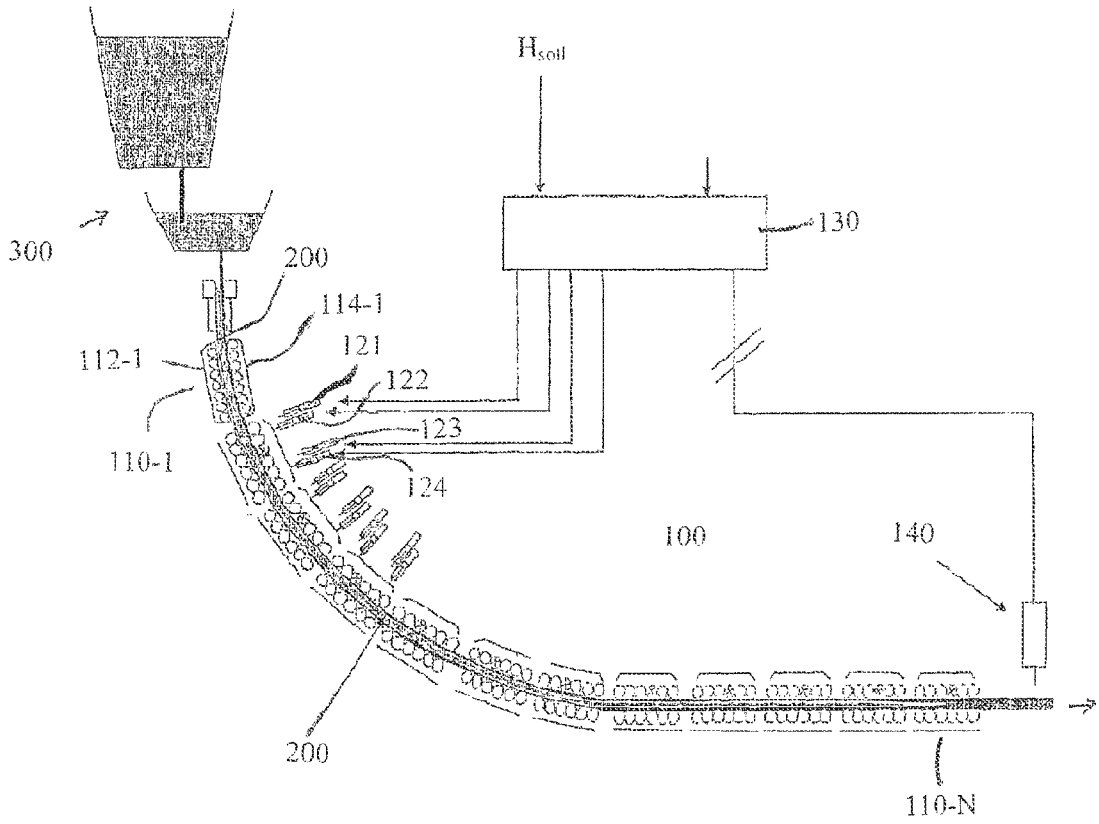
FIG. 1 shows a new strand guide in accordance with the invention.

FIG. 1 shows the strand guide of the invention for guiding a strand 200 after the strand has left a casting installation 300. The strand guide comprises a plurality of roll segments 110-*n*, where n=1-N. Each roll segment 110-*n* has an upper and a lower roll support 112, 114. Each roll support serves to support at least one roll for guiding the strand between the rolls after it leaves the casting installation. At least one roll segment (three roll segments in FIG. 1) has several adjusting elements 121-124 for adjusting the upper and lower roll supports 112, 114 relative to each other (see FIG. 2 also). Furthermore, the strand guide 100 includes a unit 130 for controlling the individual adjusting elements of the roll supports in such a way that the right and left lateral edges of the strand 200 become equally high.

The unit 130 can be designed either as an open-loop control unit or a closed-loop control unit. If it is designed solely as an open-loop control unit, then it presets, e.g., position values for the individual adjusting elements, in such a way that the right and left lateral edges of the strand are each rolled to the same height. The positions are preferably preset in such a way in each case that the right and left lateral edges of the strand are each rolled to the same predetermined set height. If the unit 130 is designed as a closed-loop control unit, it receives either measured heights for the right and left lateral edges of the strand or data which represent an actual profile, i.e., an actual cross section of the strand. The heights of the right and left lateral edges of the strand can be provided, e.g., by suitable measuring devices, which, for example, are integrated in the adjusting elements and determine specific force or pressure conditions present there between the two roll supports 112, 114 of the roll segment, from which the heights of the right and left lateral edges of the strand can be inferred. The profile of the strand can be detected, e.g., by a suitable optical profile detection unit 140; as shown in FIG. 1, this unit is preferably located at the end of the strand guide 100. A unit 130 that is designed as a closed-loop control unit is able to receive the measurement data, whether the present heights of the lateral edges or the present actual profile of the strand, and to compare these data with appropriately predetermined set quantities, i.e., either a uniform set height $H_{soll}$ predetermined for the right and left lateral edges of the strand or a set profile, for the purpose of determining a control deviation. The closed-loop control unit then controls the individual adjusting elements of the roll segment on the basis of the determined control deviation in such a way that the control deviation, if possible, goes to zero. This then guarantees that wedging that was possibly previously present in the transverse direction of the strand, i.e., in the direction of its width, is evened out before the strand enters a downstream rolling stand.

Figure 2:
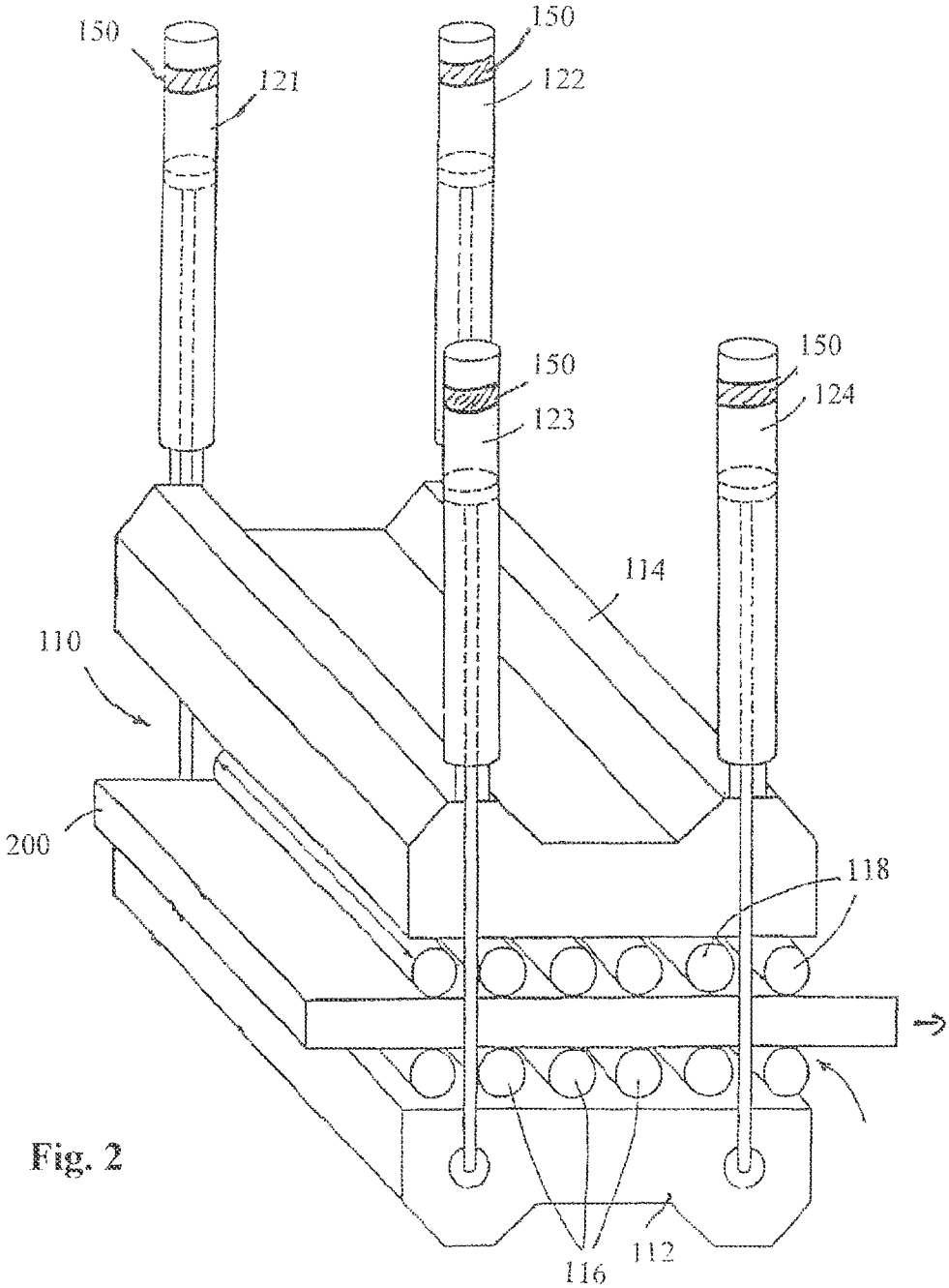
FIG. 2 shows a front view of a roll segment.

FIG. 2 shows a front view of a typical roll segment used for the realization of the invention. Parts in FIG. 2 that are the same as parts in FIG. 1 are identified with the same reference numbers. It is readily apparent that the strand 200 is guided between the rolls 116, 118 of the roll segment in the direction of material flow indicated by a horizontal arrow. It is also seen that, in the present example, each of the four corner regions of the roll segment has an adjusting element. Each adjusting element acts equally on both roll supports and thus effects movement of the upper and lower roll supports 114, 112 relative to each other. The adjusting elements 121-124 shown in FIG. 2 are realized as hydraulic cylinders. FIG. 2 also shows that the individual adjusting elements contain measuring devices 150, which are used to detect the aforementioned force or pressure conditions between the roll supports 112, 114 of the roll segment.

Figure 3:
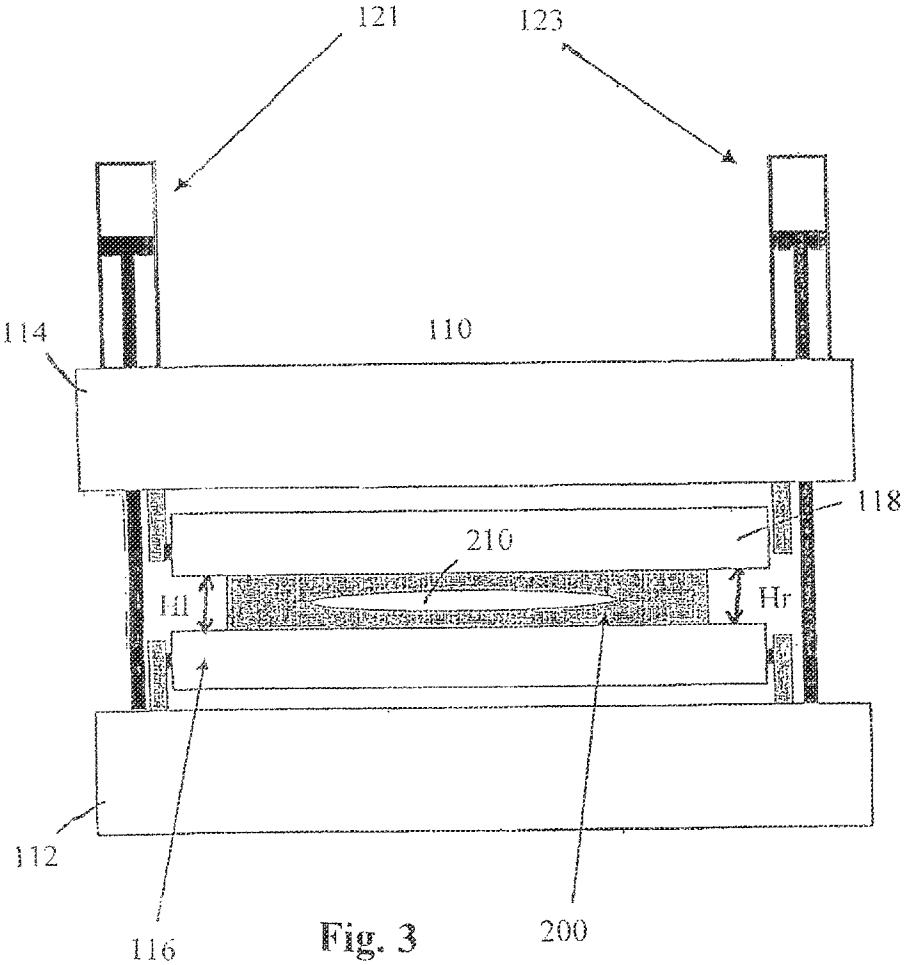
FIG. 3 shows a cross section through the roll segment.

FIG. 3 shows a cross section of the roll segment from FIG. 2. Once again, parts that are the same have the same reference numbers. The heights Hr and Hl of the right and left lateral edges of the strand 200 are shown especially well in FIG. 3. FIG. 3 also shows that, as the strand passes through the roll segment 110, it has not yet completely solidified, which is indicated by the part of the strand that is still liquid, i.e., the part of the strand indicated by reference number 210. This means that the present invention offers the advantage that the forces that need to be applied to equalize the heights Hr and Hl of the right and left lateral edges of the strand are still relatively low, i.e., lower than if the strand 200 were completely solidified.

Figure 4A:
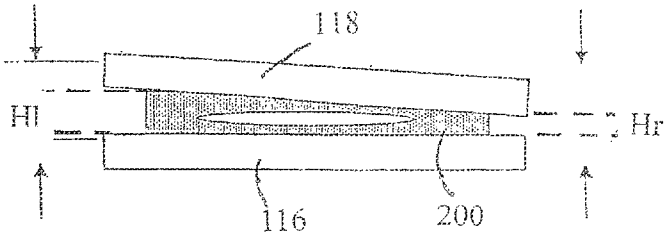
FIG. 4*a* shows a strand with wedging in the roll segment.

FIG. 4*a* shows an example of undesired wedging that has been detected in a strand 200, i.e., the heights Hr and Hl of the right and left lateral edges of this strand 200 are unequal. In accordance with the invention, the detection of this situation would trigger open-loop or closed-loop control to equalize the heights on the left and right sides of the strand.

Figure 4B:
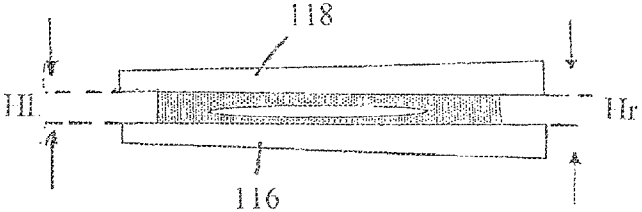
FIG. 4*b* shows a strand with no wedging between two conical rolls of a roll segment.

Finally, FIG. 4*b* shows the same strand as FIG. 4*a* but after the heights of the right and left lateral edges of the strand have been equalized in accordance with the invention. Possible unsymmetrical wear of the rolls 116, 118 of the roll segment, which in the example illustrated here has resulted in a conical shape, is of no consequence with respect to carrying out the method of the invention, because it is compensated by the claimed individual control of the adjusting elements 121-124 on the left and right sides of the strand as seen in the direction of material flow.

While specific embodiments of the invention have been shown and described in detail to illustrate the inventive principles, it will be understood that the invention may be embodied otherwise without departing from such principle

We claim:

1. A strand guide for guiding a strand after it vertically leaves a casting installation having a mold with mold walls, which strand guide comprises:

at least one roll segment arranged downstream of the mold with an upper and a lower roll support, where each roll support has a plurality of rolls for guiding the strand between the rolls after it leaves the casting installation, wherein the at least one roll segment diverts the strand from vertical to horizontal when the strand has a liquid core;

at least one adjusting element each on the right and left sides of the roll segment, as seen in the direction of material flow, for adjusting the upper and lower roll supports relative to each other, each adjusting element being arranged to act equally on both the upper roll support and the lower roll support, the at least one adjusting element being arranged where the strand has a liquid core and upstream of an exit of the roll segment; and a closed-loop control unit for individually controlling the adjusting elements; wherein an optical profile detection unit arranged at the exit of a last roll segment of the strand guide to the cross section of the strand when completely solidified at the exit of the last roll segment of the strand guide as an actual profile, including detecting the heights of the right and left lateral edges of the strand; and the closed-loop control unit is operative to control the adjusting elements of the roll supports where the strand has a liquid core based on a control deviation that results from a comparison of the detected heights of the right and left lateral edges of the solidified strand at the exit of the last roll segment by the detection unit with a set height so that the actual profile is adapted to a predetermined set profile with set heights that are the same on the right and left lateral edges of the strand so as to prevent a wedge-shaped strand cross-section from forming.

2. The strand guide in accordance with claim 1, wherein the unit is designed as an open-loop control unit or a closed-loop control unit in order to control the individual adjusting elements of the roll supports in such a way that the right and left lateral edges of the strand are each rolled to the same predetermined set height.

3. The strand guide in accordance with claim 1, wherein each of the four corner regions of the roll segment has an adjusting element.

4. The strand guide in accordance with claim 1, wherein the adjusting elements are hydraulic cylinders.

5. The strand guide in accordance with claim 1, comprising a measuring device, which is preferably integrated in the adjusting elements, for detecting force or pressure conditions between the two roll supports of the roll segment.

6. The strand guide in accordance with claim 1, wherein the closed-loop control unit includes a computer program that controls operation of the control unit.

7. A strand guide for guiding a strand after it vertically leaves a casting installation having a mold with mold walls, which strand guide comprises:

at least one roll segment arranged downstream of the mold with an upper and a lower roll support, where each roll support has at least one roll for guiding the strand between the rolls after it leaves the casting installation, wherein the at least one roll segment diverts the strand from vertical to horizontal when the strand has a liquid core;

at least one adjusting element each on the right and left sides of the roll segment, as seen in the direction of material flow, for adjusting the upper and lower roll support relative to each other, the at least one adjusting element being arranged where the strand has a liquid core and upstream of an exit of the roll segment; and a closed-loop control unit for individually controlling the adjusting elements; wherein a profile detection unit arranged at the exit of a last roll segment of the strand guide to detect the cross section of the strand when completely solidified at the exit of the last roll segment of the strand guide as an actual profile, including detecting the heights of the right and left lateral edges of the strand; and the closed-loop control unit is operative to control the adjusting elements of the roll supports where the strand has a liquid core based on a control deviation that results from a comparison of the detected heights of the right and left lateral edges of the solidified strand at the exit of the last roll segment by the detection unit with a set height so that the actual profile is adapted to a predetermined set profile with heights that are the same on the right and left lateral edges of the strand so as to prevent a wedge-shaped strand cross-section from forming.

* * * * *